US009711081B2

(12) United States Patent
Ahn et al.

(10) Patent No.: US 9,711,081 B2
(45) Date of Patent: Jul. 18, 2017

(54) ORGANIC LIGHT EMITTING DIODE DISPLAY AND METHOD FOR DRIVING THE SAME

(71) Applicant: LG DISPLAY CO., LTD., Seoul (KR)

(72) Inventors: Younghwan Ahn, Paju-si (KR); Dongwon Park, Goyang-si (KR); Joonhee Lee, Seoul (KR); Yongchul Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 60 days.

(21) Appl. No.: 14/880,898

(22) Filed: Oct. 12, 2015

(65) Prior Publication Data

US 2016/0189605 A1 Jun. 30, 2016

(30) Foreign Application Priority Data

Dec. 30, 2014 (KR) ..... 10-2014-0194442

(51) Int. Cl.

| | |
|---|---|
| ***G09G 3/3225*** | (2016.01) |
| ***G09G 3/3266*** | (2016.01) |
| ***G09G 3/20*** | (2006.01) |
| ***G09G 3/3233*** | (2016.01) |

(52) U.S. Cl.

CPC ..... *G09G 3/3225* (2013.01); *G09G 3/2022* (2013.01); *G09G 3/3233* (2013.01); *G09G 3/3266* (2013.01); *G09G 2300/0426* (2013.01); *G09G 2300/0819* (2013.01); *G09G 2300/0842* (2013.01); *G09G 2310/08* (2013.01); *G09G 2320/0223* (2013.01);

(Continued)

(58) Field of Classification Search

CPC .. G09G 3/3225; G09G 3/2022; G09G 3/3233; G09G 3/3266; G09G 2300/0426; G09G 2300/0819; G09G 2300/0842; G09G 2310/08; G09G 2320/0223

See application file for complete search history.

(56) References Cited

U.S. PATENT DOCUMENTS 6,208,325 B1 * 3/2001 Reddy ..... G06F 3/1431 345/656
6,816,142 B2 * 11/2004 Oda ..... G09G 3/2011 345/103

(Continued)

OTHER PUBLICATIONS

European Extended Search Report, European Application No. 15175885.1, Feb. 19, 2016, 14 pages.

*Primary Examiner* — Kumar Patel
*Assistant Examiner* — Sejoon Ahn
(74) *Attorney, Agent, or Firm* — Fenwick & West LLP

(57) ABSTRACT

An organic light emitting diode display and a method for driving the same are disclosed. The organic light emitting diode display includes a display panel including a plurality of pixels, a display panel driver configured to drive signal lines of the display panel, and a timing controller configured to divide one frame into a plurality of subframes, convert data of an input image into a bit pattern, map the bit pattern to the plurality of subframes, control an operation of the display panel driver, and adjust a writing speed for writing data and/or an erase speed for turning off pixels of the plurality of pixels during at least one compensation sub-frame of the plurality of subframes such that the write speed and the erase speed are different from each other.

17 Claims, 15 Drawing Sheets

(52) U.S. Cl.
CPC ..... *G09G 2320/0233* (2013.01); *G09G 2330/021* (2013.01); *G09G 2330/027* (2013.01); *G09G 2330/028* (2013.01)

(56) References Cited

U.S. PATENT DOCUMENTS

| | | | | |
|---|---|---|---|---|
| 6,909,419 | B2 * | 6/2005 | Zavracky | G06F 1/1616 345/102 |
| 7,474,282 | B2 | 1/2009 | Okamoto | |
| 2004/0227881 | A1 * | 11/2004 | Okazaki | G02F 1/1337 349/123 |
| 2010/0188393 | A1 | 7/2010 | Seki | |
| 2012/0320005 | A1 * | 12/2012 | Goden | G09G 3/2022 345/204 |

* cited by examiner

| Vertical line | Luminance of related art(nit) | Luminance of present invention(nit) |
|---|---|---|
| 0 | 150 | 149.2938 |
| 128 | 141.5894 | 148.8657 |
| 256 | 134.4414 | 148.2237 |
| 384 | 128.7702 | 148.0739 |
| 512 | 124.7682 | 147.6459 |
| 640 | 122.5638 | 146.8754 |
| 768 | 121.2584 | 145.7626 |

ORGANIC LIGHT EMITTING DIODE DISPLAY AND METHOD FOR DRIVING THE SAME

This application claims the benefit of Korea Patent Application No. 10-2014-0194442 filed on Dec. 30, 2014, which is incorporated herein by reference for all purposes as if fully set forth herein.

BACKGROUND

Field

The present disclosure relates to an organic light emitting diode display driven through a digital driving method and a method for driving the same.

Discussion of Related Art

Because an organic light emitting diode display (hereinafter, referred to as "OLED display") is a self-emission display device, the OLED display may be manufactured to have lower power consumption and thinner profile than a liquid crystal display which requires a backlight unit. Further, the OLED display has advantages of a wide viewing angle and a fast response time and thus has expanded its market while competing with the liquid crystal display.

The OLED display is driven through an analog voltage driving method or a digital driving method and using grayscale values of an input image. The analog voltage driving method adjusts a data voltage applied to pixels based on data gray values of the input image and adjusts a luminance of the pixels based on a magnitude of the data voltage, thereby representing grayscale of the input image. The digital driving method adjusts an emission time of the pixels based on the data gray values of the input image, thereby representing grayscale of the input image.

As shown in FIGS. 1 and 2, the digital driving method time-divides one frame into a plurality of subframes SF1 to SF6. Each subframe represents one bit of input image data. As shown in FIG. 1, each subframe may include a writing time ADT, during which data is written on pixels, and an emission time EMT, during which the pixels emit light. As shown in FIG. 2, each subframe may further include an erase time ERT, during which the pixels are turned off, in addition to the writing time ADT and the emission time EMT. The emission times of the subframes may have different lengths. However, all of the subframes are the same as one another in a scan direction for writing the data and an erase direction for turning off the pixels. In addition, a writing speed for writing the data and an erase speed for turning off the pixels in each subframe are the same as each other. Therefore, the emission time of the same subframe is uniform irrespective of a position of the display panel.

Because the emission time of the same subframe is uniform, there should be negligible luminance deviation across pixels irrespective of the position of the pixel within the display panel. However, as shown in FIG. 3, because variations IR drop resulting from varying line resistances occur in the display panel, a high potential power voltage EVDD varies depending on a spatial position of the display panel to thereby generate the luminance deviation. The luminance implemented in the display panel decreases as the display panel is far from an input terminal of the high potential power voltage EVDD.

In the analog voltage driving method, a driving thin film transistor (TFT) is driven in a saturation region. As shown in FIG. 4, the saturation region is a voltage region, in which a drain-source current Ids does not substantially change as a function of a drain-source voltage Vds of the driving TFT, and is positioned on the right side of the Vds-Ids plane (for values of Vds above a threshold). In other words, in the saturation region, the drain-source current Ids does not change although the high potential power voltage EVDD (i.e., the drain-source voltage Vds of the driving TFT) changes.

On the other hand, in the digital driving method, the driving TFT is driven in an active region, so as to reduce power consumption. As shown in FIG. 4, the active region indicates a voltage region, in which the drain-source current Ids changes depending on the drain-source voltage Vds of the driving TFT, and is positioned on the left side of the Vds-Ids plane (for values of Vds below a threshold). In other words, in the active region, the drain-source current Ids changes depending on changes in the high potential power voltage EVDD (i.e., the drain-source voltage Vds of the driving TFT).

For this reason, the luminance deviation resulting from the IR drop is more of a problem in the digital driving method than the analog voltage driving method.

SUMMARY

Accordingly, the present disclosure provides an organic light emitting diode display driven through a digital driving method and a method for driving the same capable of reducing (e.g., minimizing) a luminance deviation resulting from variable IR drops across signal lines.

An organic light emitting diode display comprises a display panel including a plurality of pixels; a display panel driver configured to drive signal lines of the display panel; and a timing controller configured to divide one frame into a plurality of subframes, divide data of an input image at each bit, map the data of the input image to the plurality of subframes, control an operation of the display panel driver, and differently adjust a writing speed for writing data and an erase speed for turning off the pixels in at least one compensation frame of the plurality of subframes.

Some embodiments provide a method for driving an organic light emitting diode display that includes a display panel including a plurality of pixels, and a display panel driver driving signal lines of the display panel. The method comprising dividing one frame into a plurality of subframes, dividing data of an input image at each bit, and mapping the data of the input image to the plurality of subframes; and controlling an operation of the display panel driver and differently adjusting a writing speed for writing data and an erase speed for turning off the pixels in at least one compensation frame of the plurality of subframes.

BRIEF DESCRIPTION OF THE DRAWINGS

The accompanying drawings, which are included to provide a further understanding of the present disclosure and are incorporated in and constitute a part of this specification. The drawings illustrate embodiments and together with the description serve to explain the principles of the present disclosure. In the drawings.

DETAILED DESCRIPTION OF THE ILLUSTRATED EMBODIMENTS

Reference will now be made in detail to embodiments, examples of which are illustrated in the accompanying drawings. Wherever possible, the like reference numbers will be used throughout the drawings to refer to the like parts.

Figure 5:
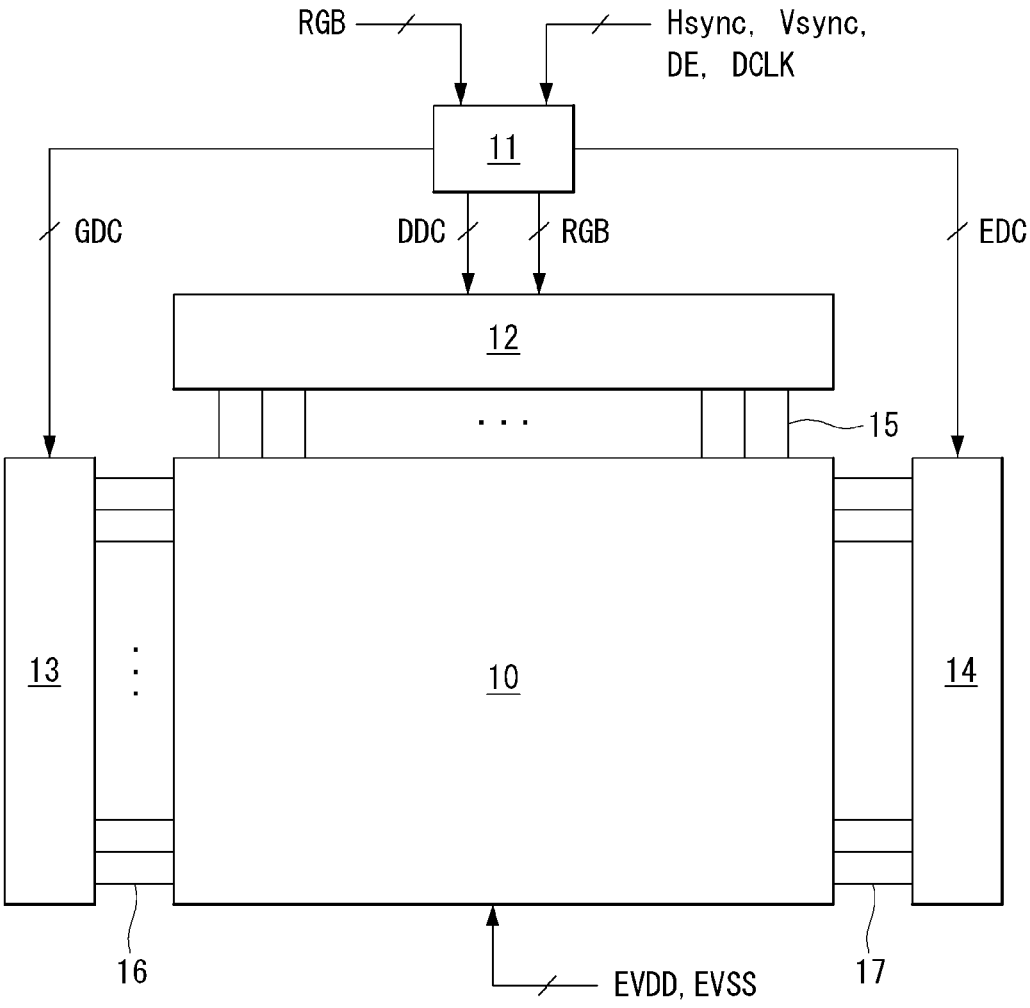
FIGS. 5 and 6 show an organic light emitting diode display according to one or more embodiments.
Figure 6:
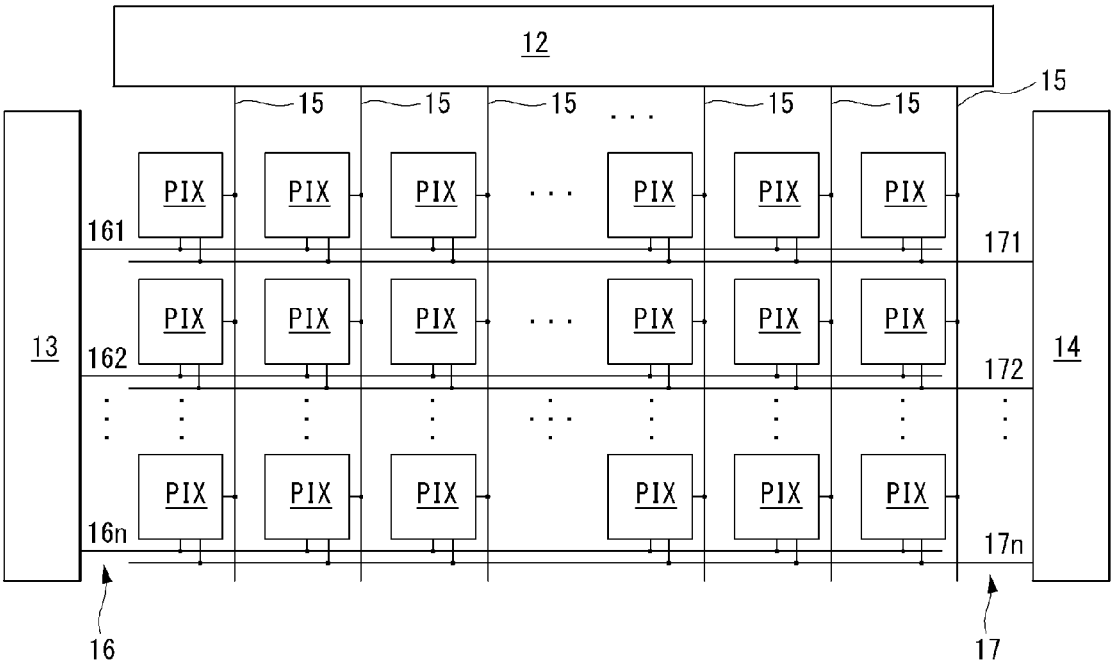
Figure 7:
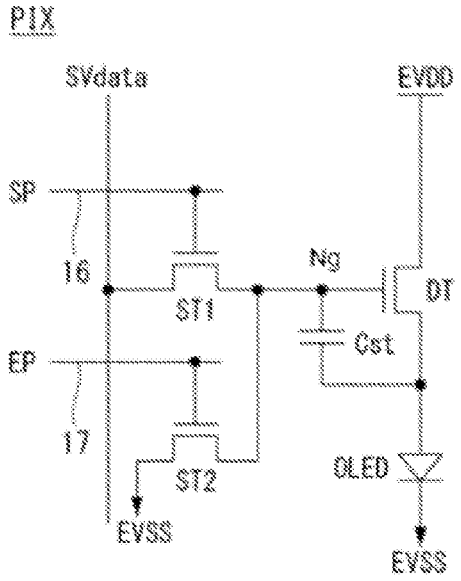
FIG. 7 includes a circuit diagram showing one pixel of the organic light emitting diode display shown in FIG. 6, according to one or more embodiments.

FIGS. 5 to 7 show an organic light emitting diode display (hereinafter, referred to as "OLED display") according to an embodiment.

Referring to FIGS. 5 to 7, the OLED display according to an embodiment includes a display panel 10, display panel drivers 12, 13, and 14 for writing pixel data of an input image on a pixel array of the display panel 10, and a timing controller 11 for controlling the display panel drivers 12, 13, and 14.

On the pixel array of the display panel 10, a plurality of data lines 15 and a plurality of first and second gate lines 16 and 17 cross each other. The pixel array of the display panel 10 includes pixels PIX, that are arranged in a matrix form and display the input image. Each pixel PIX may be one of a red (R) pixel, a green (G) pixel, a blue (B) pixel, and a white (W) pixel. As shown in FIG. 7, each pixel PIX may include a plurality of thin film transistors (TFTs), an organic light emitting diode (OLED), a capacitor, and the like.

The display panel drivers 12, 13, and 14 include a data driver 12, and first and second gate drivers 13 and 14.

The data driver 12 generates a data voltage SVdata based on data RGB of the input image received from the timing controller 11 and outputs the data voltage SVdata to the data lines 15. In a digital driving method, an amount of light emitted by the pixels PIX is uniform, and grayscale of the data RGB is represented through an amount of emission time, during which the pixels PIX emit light. Therefore, the data driver 12 selects one of a voltage (hereinafter, referred to as "on-voltage") satisfying an emission condition of the pixels PIX and a voltage (hereinafter, referred to as "off-voltage") not satisfying the emission condition of the pixels PIX depending on digital values of the data RGB mapped to the subframe, and generates the data voltage SVdata.

The first gate driver 13 sequentially supplies a scan pulse (or a gate pulse) SP synchronized with the data voltage SVdata of the data driver 12 to the first gate lines 16 (i.e., 161 to 16*n*) under the control of the timing controller 11. The first gate driver 13 sequentially shifts the scan pulse SP and sequentially selects the pixels PIX, to which the data voltage SVdata is applied, on a per line basis.

The second gate driver 14 sequentially supplies an erase pulse EP to the second gate lines 17 (i.e., 171 to 17*n*) under the control of the timing controller 11. The pixels PIX stop emitting light in response to the erase pulse EP. The timing controller 11 controls application timing of the erase pulse EP and controls an emission time of each subframe.

The timing controller 11 receives the pixel data RGB of the input image and timing signals synchronized with the pixel data RGB from a host system (not shown). The timing controller 11 controls operation timing of the data driver 12 and operation timing of the gate drivers 13 and 14 based on the timing signals synchronized with the pixel data RGB of the input image. The timing signals include a vertical sync signal Vsync, a horizontal sync signal Hsync, a data enable signal DE, a dot clock DCLK, and the like. The timing controller 11 generates a source timing control signal DDC controlling the operation timing of the data driver 12, a first gate timing control signal GDC controlling the operation timing of the first gate driver 13, and a second gate timing control signal EDC controlling the operation timing of the second gate driver 14.

The timing controller 11 controls the display panel drivers 12, 13, and 14 through the digital driving method. The timing controller 11 divides one frame into a plurality of subframes. Lengths of the emission times of the subframes may be differently set depending on a data bit of the input image. For example, the most significant bit (MSB) represents a highest gray level and thus may be mapped to the subframe having the longest emission time, and the least significant bit (LSB) represents a lowest gray level and thus may be mapped to the subframe having the shortest emission time. The timing controller 11 maps the data RGB of the input image to the subframe at each bit and transmits the data RGB to the data driver 12.

As shown in FIGS. 8, 10, 12, and 14, each subframe may further include an erase time ERT, during which the pixels PIX are turned off, as well as a writing time ADT, during which the data is written on the pixels PIX, and an emission time EMT, during which the pixels PIX emit light. As described above, the emission times EMT of the subframes may have different lengths.

The timing controller 11 controls operations of the display panel drivers 12, 13, and 14 and differently adjusts a writing speed for the data write (indicating the application of the data voltage) and an erase speed for turning off the pixels PIX in at least one compensation subframe of the plurality of subframes. Hence, the timing controller 11 differently adjusts emission times of upper and lower display lines of the display panel 10 and can suppress a luminance deviation resulting from IR drop depending on a position of the display panel 10. This is described in detail later with reference to FIGS. 8 to 13.

The timing controller 11 controls the operations of the display panel drivers 12, 13, and 14 and reversely adjusts a scan direction for the data write and an erase direction for turning off the pixels PIX in at least one compensation subframe of the plurality of subframes. Hence, the timing controller 11 differently adjusts emission times of the upper and lower display lines of the display panel 10 and can suppress the luminance deviation resulting from the IR drop depending on the position of the display panel 10. This is described in detail later with reference to FIGS. 14 to 15C.

The host system may be implemented as one of a television system, a set-top box, a navigation system, a DVD player, a Blu-ray player, a personal computer (PC), a home theater system, and a phone system.

As shown in FIG. 7, each pixel PIX includes an OLED, a driving TFT DT, a first switching TFT ST1, a second switching TFT ST2, a storage capacitor Cst, and the like.

The OLED has a stack structure of organic compound layers including a hole injection layer HIL, a hole transport layer HTL, an emission layer EML, an electron transport layer ETL, an electron injection layer EIL, etc. The OLED generates light when electrons and holes combine in the emission layer EML.

Figure 1:
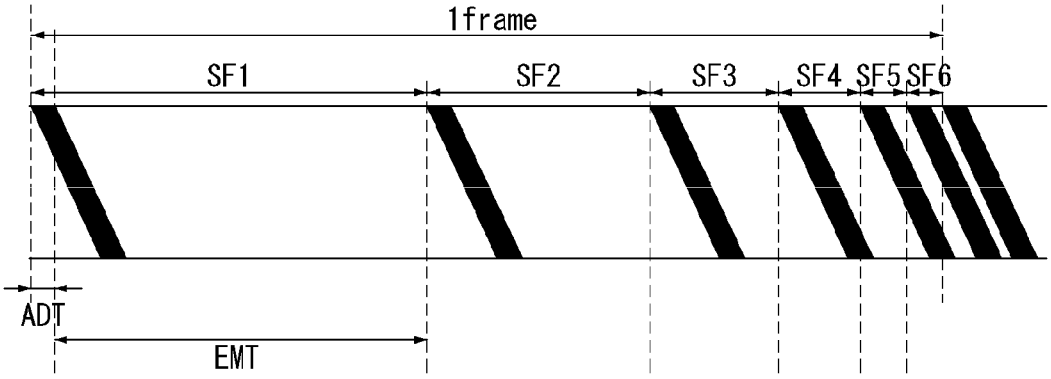
FIG. 1 (RELATED ART)
FIGS. 1 and 2 illustrate a related art digital driving method.
Figure 2:
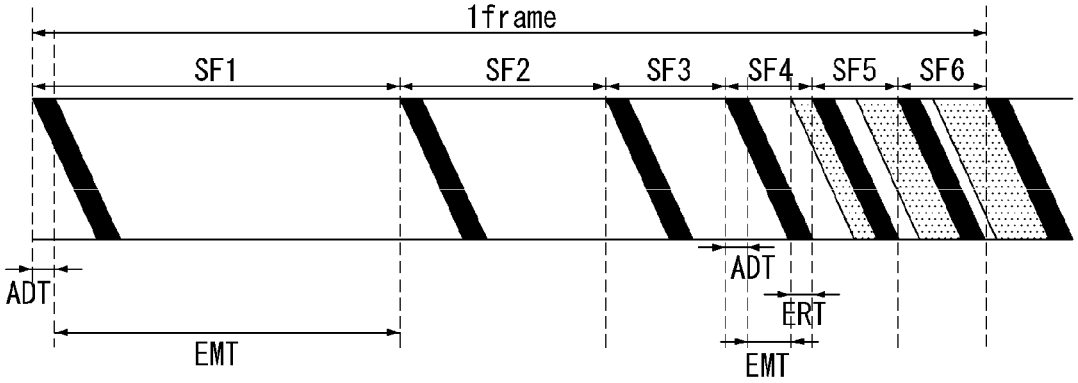
FIG. 2 (RELATED ART)
Figure 3:
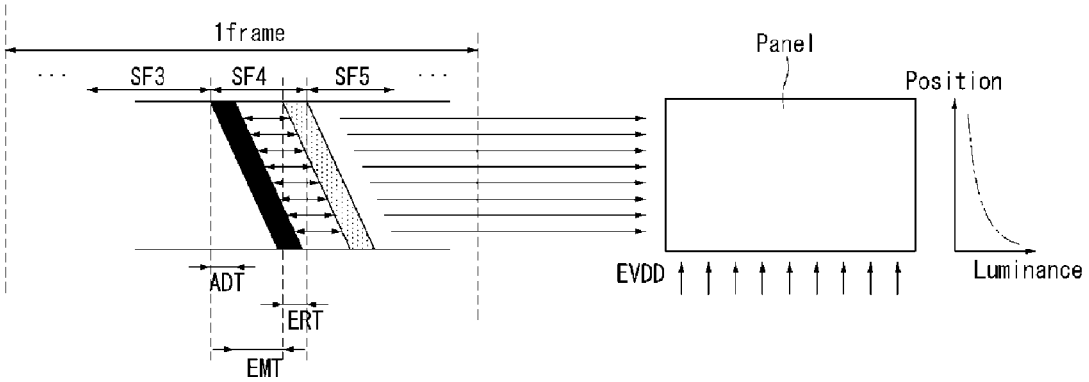
FIG. 3 (RELATED ART)
FIG. 3 shows that a luminance deviation resulting from IR drop is generated depending on a position of a display panel according to the related art.
Figure 4:
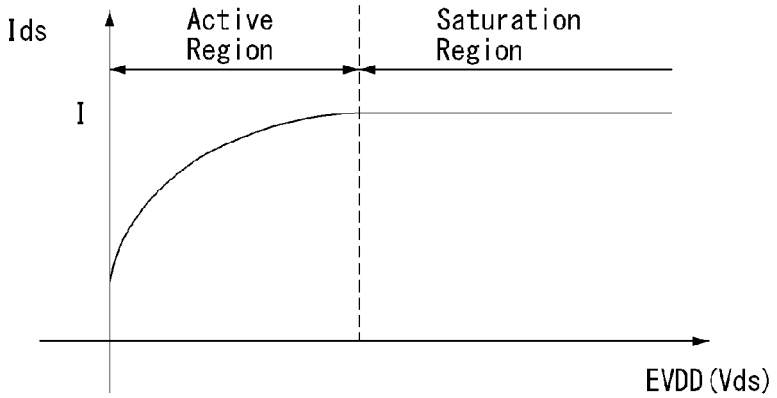
FIG. 4 (RELATED ART)
FIG. 4 shows a graph indicating operating characteristics of a driving thin film transistor (TFT) according to the related art.

The driving TFT DT operates in the active region shown in FIG. 4 and makes the OLED emit light. The driving TFT DT is connected between a power line, to which a high potential power voltage EVDD is supplied, and the OLED and switches on or off a current flowing in the OLED depending on a voltage state of a gate node Ng. The driving TFT DT is turned on when the gate node Ng is in an on-voltage state, and applies a driving current to the OLED, thereby making the OLED emit light. The driving TFT DT is turned off when the gate node Ng is in an off-voltage state, and cuts off the driving current applied to the OLED, thereby turning off the OLED. Namely, the OLED does not emit light.

The first switching TFT ST1 is turned on in response to the scan pulse SP from the first gate line 16. The first switching TFT ST1 supplies the data voltage SVdata of the on-voltage or the off-voltage to the gate node Ng in response to the scan pulse SP.

The second switching TFT ST2 is turned on in response to the erase pulse EP from the second gate line 17. The second switching TFT ST2 makes a voltage of the gate node Ng in an off-voltage state in response to the erase pulse EP.

The storage capacitor Cst maintains the voltage of the gate node Ng of the driving TFT DT.

Each pixel PIX of the display panel 10 according to an embodiment is not limited to the structure shown in FIG. 7 and may have any pixel structure capable of performing the digital driving method.

Figure 8:
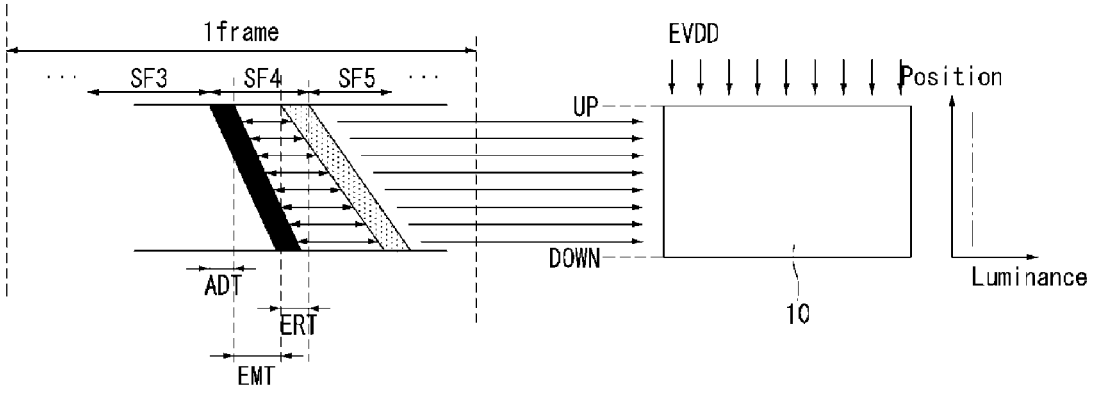
FIG. 8 shows an example where an erase speed and a writing speed in a specific compensation subframe are adjusted to differ across pixels as a method for minimizing a luminance deviation resulting from IR drop, according to one or more embodiments.
Figure 9:
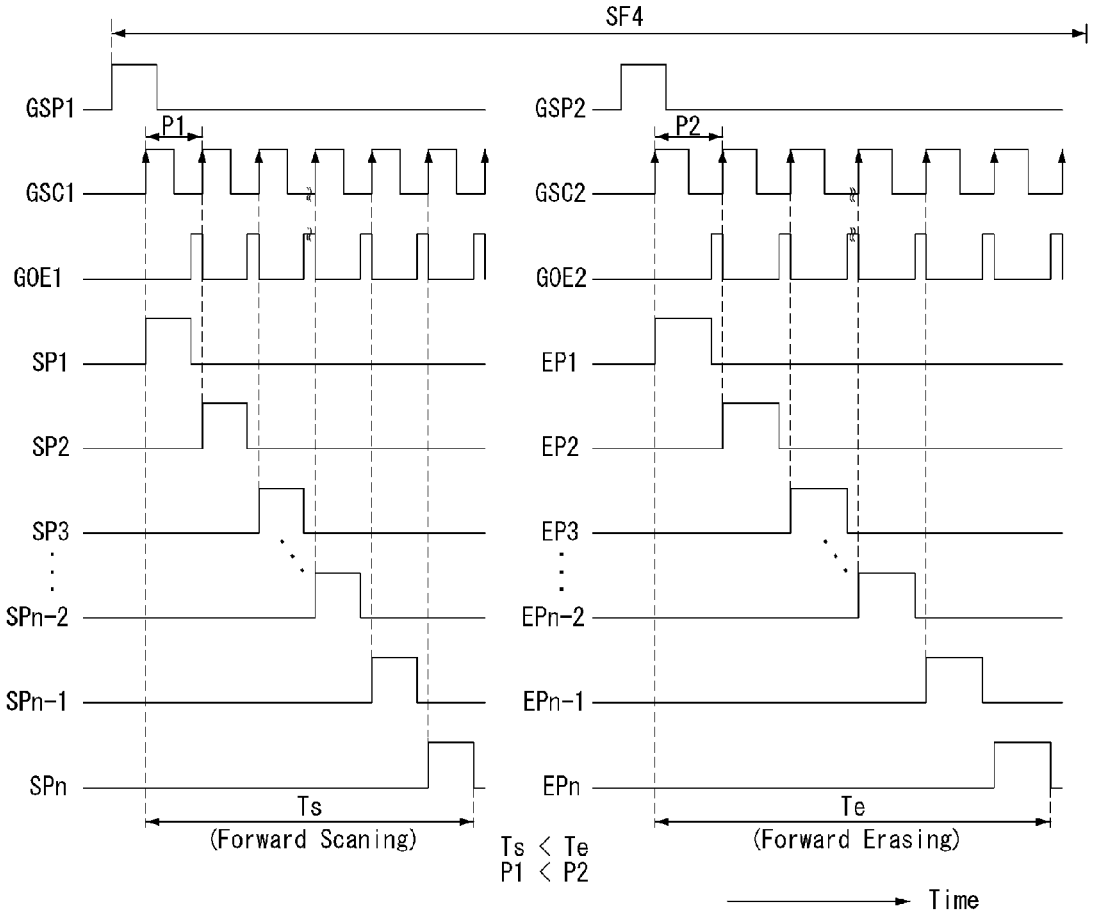
FIG. 9 shows a timing diagram of a total application time of scan signals and a total application time of erase signals in the specific compensation subframe are differently controlled so as to implement the method shown in FIG. 8, according to one or more embodiments.

FIG. 8 shows an example where an erase speed and a writing speed in a specific compensation subframe are differently adjusted as a method for minimizing the luminance deviation resulting from the variable IR drop. FIG. 9 shows that a total application time of the scan signals and a total application time of the erase signals in the specific compensation subframe are differently controlled so as to implement the method shown in FIG. 8.

As shown in FIG. 8, in the OLED display according to an embodiment, the high potential power voltage EVDD for driving the pixels is applied to the display panel 10 from the upper side UP of the display panel 10, and the data write may be sequentially performed from the upper side UP to the lower side DOWN of the display panel 10 in a sequential line manner. In this instance, a luminance at the lower side DOWN of the display panel 10 may be less than a luminance at the upper side UP of the display panel 10 because of the IR drop.

To remove the luminance deviation depending on the position of the display panel 10, the timing controller 11 controls the operations of the display panel drivers 12, 13, and 14 such that an erase speed for turning off the pixels is slower than a writing speed for the data write in at least one compensation subframe (for example, SF4) of a plurality of subframes belonging to one frame. Hence, as it goes from the upper side UP to the lower side DOWN of the display panel 10, the emission time EMT may gradually increase.

The writing speed is determined in inverse proportion to a total application time of the scan signals for writing the data in the compensation subframe SF4, and the erase speed is determined in inverse proportion to a total application time of the erase signals for turning off the pixels in the compensation subframe SF4.

As shown in FIG. 9, the timing controller 11 may cause a total application time Te of erase signals EP1 to EPn to be longer than a total application time Ts of scan signals SP1 to SPn, so that the erase speed is slower than the writing speed in the compensation subframe SF4. For this, the timing controller 11 may cause a first gate shift clock GSC1, that forms the basis of the generation of the scan signals SP1 to SPn, to have a first pulse period P1 and cause a second gate shift clock GSC2, that forms the basis of the generation of the erase signals EP1 to EPn, to have a second pulse period P2 longer than the first pulse period P1.

The first gate driver 13 receives the first gate shift clock GSC1, a first gate start pulse GSP1, and a first gate output enable signal GOE1 from the timing controller 11 and generates the scan signals SP1 to SPn in synchronization with a rising edge of the first gate shift clock GSC1. The first gate driver 13 sequentially supplies the scan signals SP1 to SPn to the first gate lines 16 and scans the display lines of the display panel 10 in a forward direction during the total scanning time Ts.

The second gate driver 14 receives the second gate shift clock GSC2, a second gate start pulse GSP2, and a second gate output enable signal GOE2 from the timing controller 11 and generates the erase signals EP1 to EPn in synchronization with a rising edge of the second gate shift clock GSC2. The second gate driver 14 sequentially supplies the erase signals EP1 to EPn to the second gate lines 17 and erases the display lines of the display panel 10 in the forward direction during the total erase time Te longer than the total scanning time Ts.

As described above, this causes the erase speed to be slower than the writing speed when the high potential power voltage EVDD is applied to the display panel 10 from the upper side UP of the display panel 10 as shown in FIG. 8, and gradually increases the emission time EMT as it goes from the upper side UP to the lower side DOWN of the display panel 10, thereby removing the luminance deviation resulting from the IR drop depending on the position of the display panel 10.

Figure 10:
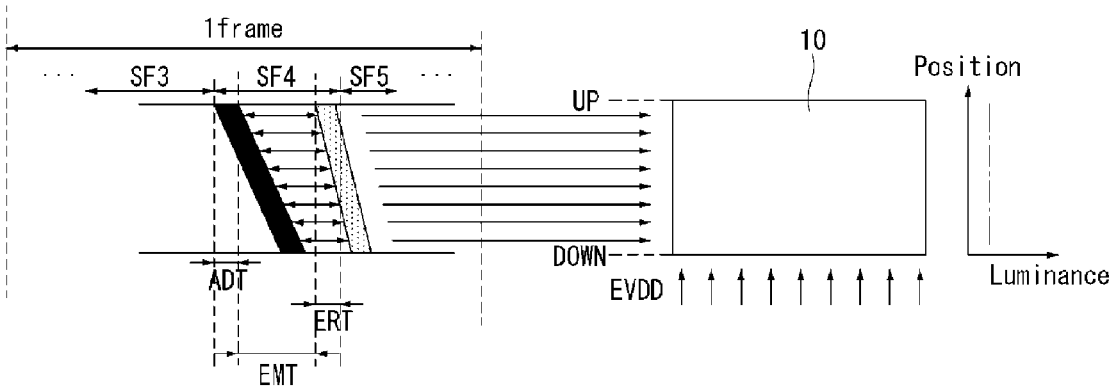
FIG. 10 shows another example where an erase speed and a writing speed in a specific compensation subframe are differently adjusted as a method for reducing a luminance deviation resulting from IR drop, according to one or more embodiments.
Figure 11:
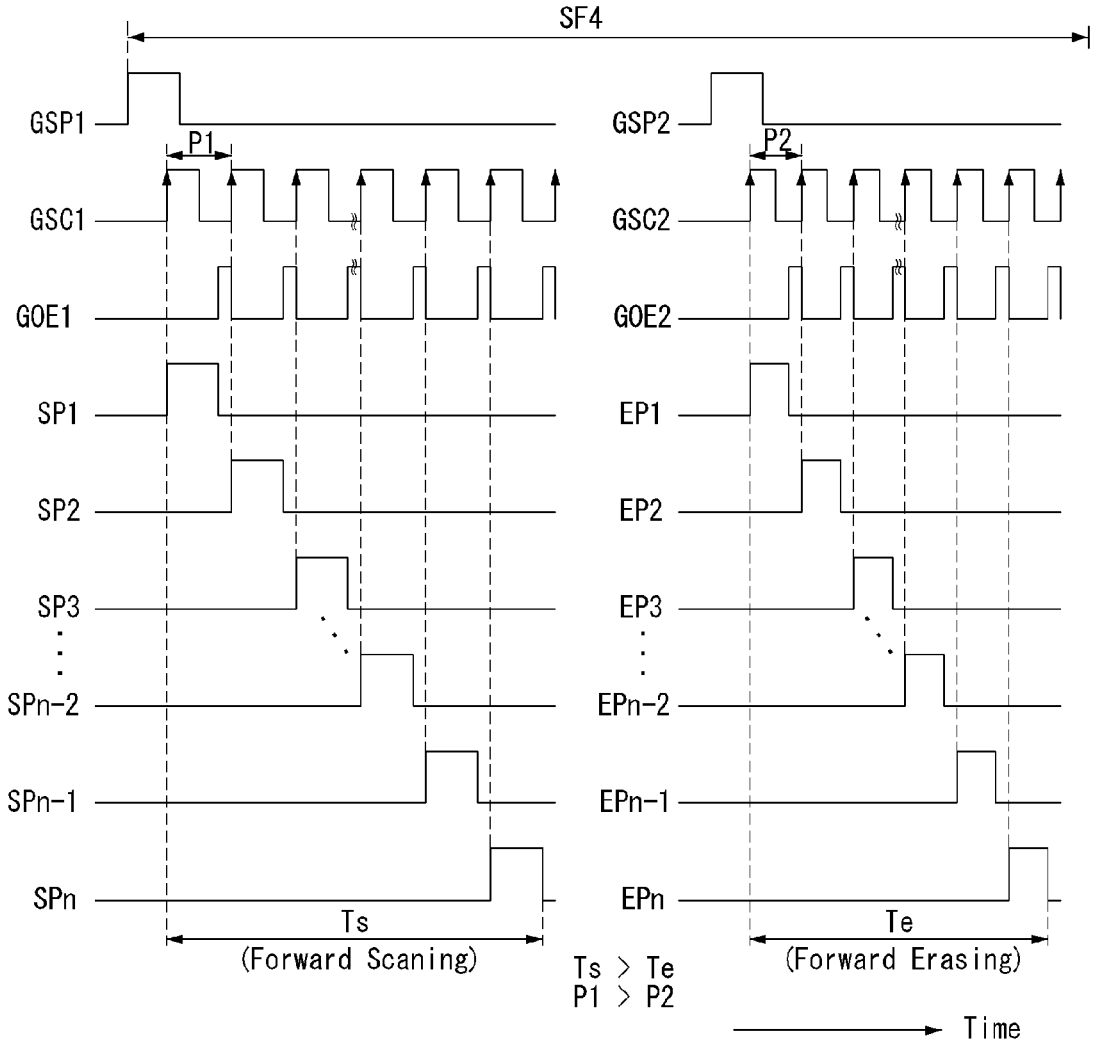
FIG. 11 shows a timing diagram of a total application time of scan signals and a total application time of erase signals in the specific compensation subframe are differently controlled so as to implement the method shown in FIG. 10, according to one or more embodiments.

FIG. 10 shows another example where an erase speed and a writing speed in a specific compensation subframe are differently adjusted as a method for minimizing the luminance deviation resulting from variations in IR drop across signal lines for pixels of the panel. FIG. 11 shows that a total application time of the scan signals and a total application time of the erase signals in the specific compensation subframe are differently controlled (e.g., varied) so as to implement the method shown in FIG. 10.

As shown in FIG. 10, in the OLED display according to a further embodiment, the high potential power voltage EVDD for driving the pixels is applied to the display panel 10 from the lower side DOWN of the display panel 10, and the data write may be sequentially performed from the upper side UP to the lower side DOWN of the display panel 10 in the sequential line manner. In this instance, a luminance at the upper side UP of the display panel 10 may be less than a luminance at the lower side DOWN of the display panel 10 because of the IR drop.

To remove the luminance deviation depending on the position of the display panel 10, the timing controller 11 controls the operations of the display panel drivers 12, 13, and 14 such that an erase speed for turning off the pixels is faster than a writing speed for the data write in at least one compensation subframe (for example, SF4) of a plurality of subframes belonging to one frame. Hence, progressing from the lower side (labeled in FIG. 10 as DOWN) to the upper side (labeled in FIG. 10 as UP) of the display panel 10, the emission time EMT may gradually increase.

As shown in FIG. 11, the timing controller 11 may cause a total application time Te of the erase signals EP1 to EPn to be shorter than a total application time Ts of the scan signals SP1 to SPn, so that the erase speed is faster than the writing speed in the compensation subframe SF4. For this, the timing controller 11 may cause a first gate shift clock GSC1, that forms the basis of the generation of the scan signals SP1 to SPn, to have a first pulse period P1 and cause a second gate shift clock GSC2, that forms the basis of the generation of the erase signals EP1 to EPn, to have a second pulse period P2 shorter than the first pulse period P1.

The first gate driver 13 receives the first gate shift clock GSC1, a first gate start pulse GSP1, and a first gate output enable signal GOE1 from the timing controller 11 and generates the scan signals SP1 to SPn in synchronization with a rising edge of the first gate shift clock GSC1. The first gate driver 13 sequentially supplies the scan signals SP1 to SPn to the first gate lines 16 and scans the display lines of the display panel 10 in the forward direction during the total scanning time Ts.

The second gate driver 14 receives the second gate shift clock GSC2, a second gate start pulse GSP2, and a second gate output enable signal GOE2 from the timing controller 11 and generates the erase signals EP1 to EPn in synchronization with a rising edge of the second gate shift clock GSC2. The second gate driver 14 sequentially supplies the erase signals EP1 to EPn to the second gate lines 17 and erases the display lines of the display panel 10 in the forward direction during the total erase time Te shorter than the total scanning time Ts.

As described above, this causes the erase speed to be faster than the writing speed when the high potential power voltage EVDD is applied to the display panel 10 from the lower side DOWN of the display panel 10 as shown in FIG. 10, and gradually increases the emission time EMT as it goes from the lower side DOWN to the upper side UP of the display panel 10, thereby removing the luminance deviation resulting from the IR drop depending on the position of the display panel 10.

Figure 12:
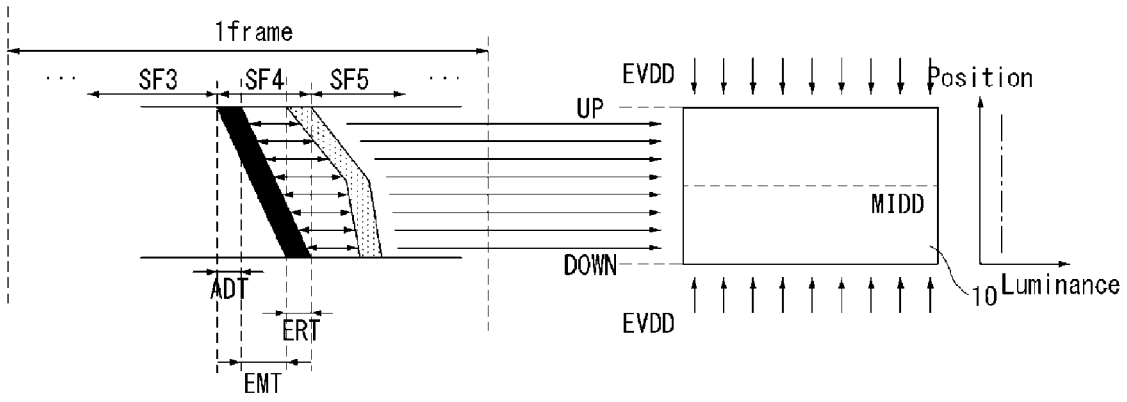
FIG. 12 shows an example where an erase speed and a writing speed in a specific compensation subframe are differently adjusted, and an erase speed of a portion of the specific compensation subframe is different from an erase speed of a remaining portion, as a method for minimizing a luminance deviation resulting from IR drop, according to one or more embodiments.
Figure 13:
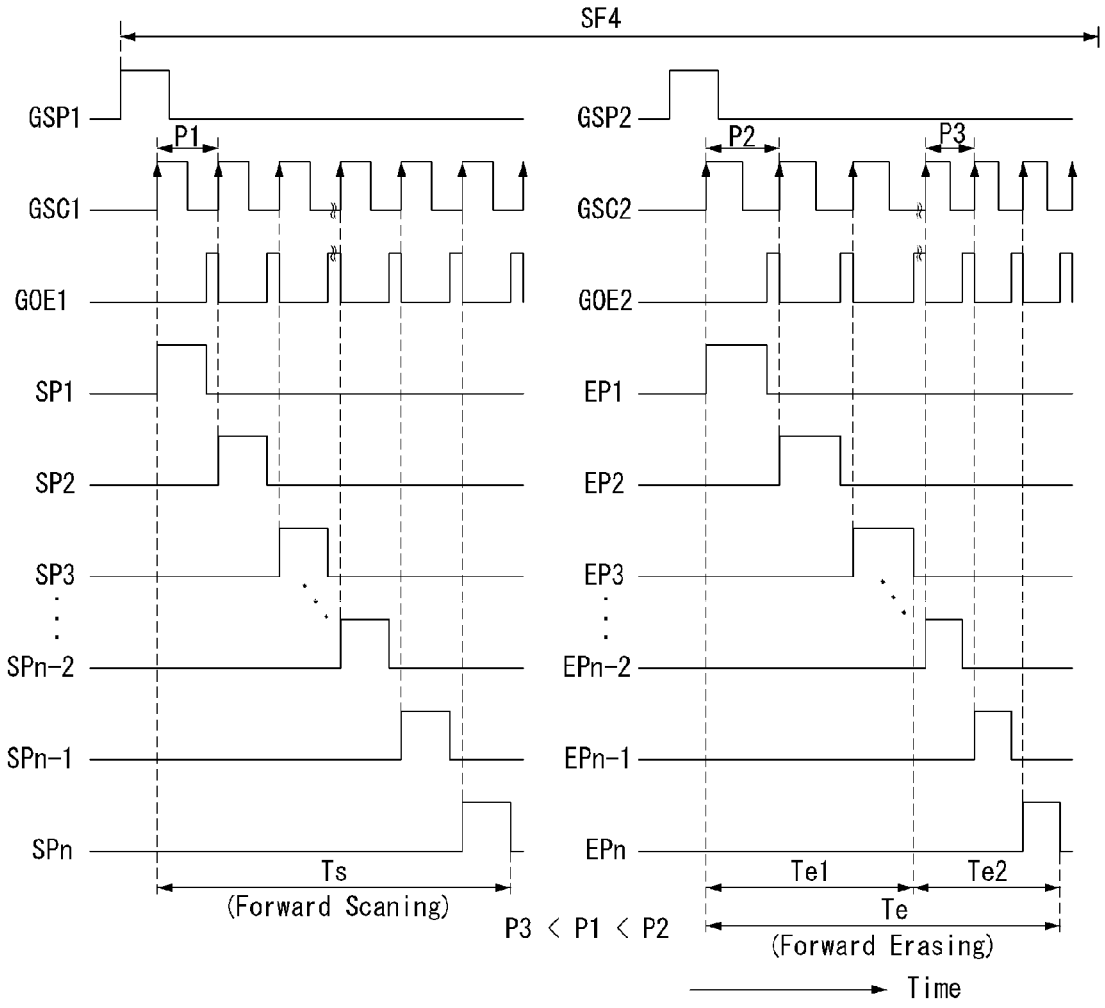
FIG. 13 shows a timing diagram of application times of erase signals in the specific compensation subframe are differently controlled depending on portions divided from the specific compensation subframe, so as to implement the method shown in FIG. 12, according to one or more embodiments.

FIG. 12 shows an example where an erase speed and a writing speed in a specific compensation subframe are differently adjusted, and an erase speed in a portion of the specific compensation subframe is different from an erase speed in a remaining portion, as a method for minimizing the luminance deviation resulting from variations in the IR drop across signal lines for pixels of the panel. FIG. 13 shows that application times of erase signals in the specific compensation subframe are differently controlled depending on portions divided from the specific compensation subframe, so as to implement the method shown in FIG. 12.

As shown in FIG. 12, in the OLED display according to a yet further embodiment, the high potential power voltage EVDD for driving the pixels is simultaneously applied to the display panel 10 from both the upper side UP and the lower side DOWN of the display panel 10, and the data write may be sequentially performed from the upper side UP and the lower side DOWN of the display panel 10 in the sequential line manner. In this instance, a luminance at the middle part MIDD of the display panel 10 may be less than a luminance at the upper side UP and the lower side DOWN of the display panel 10 because of the IR drop.

To remove the luminance deviation depending on the position of the display panel 10, the timing controller 11 controls the operations of the display panel drivers 12, 13, and 14 such that an erase speed is slower than a writing speed in a portion of at least one compensation subframe (for example, SF4) of a plurality of subframes belonging to one frame, and then the erase speed is faster than the writing speed in a remaining portion of the compensation subframe SF4. Hence, proceeding from the upper side UP to the middle part MIDD of the display panel 10 and from the lower side DOWN to the middle part MIDD of the display panel 10, the emission time EMT may gradually increase.

The erase signals EP1 to EPn include first erase signals EP1 to EPk applied in a portion of the compensation subframe SF4 corresponding to a portion (subregion) of the panel and second erase signals EP(k+1) to EPn applied in a remaining portion of the compensation subframe SF4 corresponding to a remaining portion (subregion) of the panel. In this instance, as shown in FIG. 13, the timing controller 11 may cause a total application time Te of the erase signals EP1 to EPn to be same as a total application time Ts of the scan signals SP1 to SPn. But the total application time Te of the erase signals EP1 to EPn may be divided into a first erase time Te1, during which the first erase signals EP1 to EPk are applied, and a second erase time Te2, during which the second erase signals EP(k+1) to EPn are applied. The timing controller may cause the first erase time Te1 to be longer than the second erase time Te2, so as to differently adjust the erase speed depending on the portions of the divided compensation subframe SF4.

For this, the timing controller 11 may cause a first gate shift clock GSC1, that forms the basis of the generation of the scan signals SP1 to SPn, to have a first pulse period P1 and cause a second gate shift clock GSC2, that forms the basis of the generation of the erase signals EP1 to EPn, to have a second pulse period P2 longer than the first pulse period P1 during the first erase time Te1 and to have a third pulse period P3 shorter than the first pulse period P1 during the second erase time Te2.

The first gate driver 13 receives the first gate shift clock GSC1, a first gate start pulse GSP1, and a first gate output enable signal GOE1 from the timing controller 11 and generates the scan signals SP1 to SPn in synchronization with a rising edge of the first gate shift clock GSC1. The first gate driver 13 sequentially supplies the scan signals SP1 to SPn to the first gate lines 16 and scans the display lines of the display panel 10 in the forward direction during the total scanning time Ts.

The second gate driver 14 receives the second gate shift clock GSC2, a second gate start pulse GSP2, and a second gate output enable signal GOE2 from the timing controller 11 and generates the erase signals EP1 to EPn in synchronization with a rising edge of the second gate shift clock GSC2. The second gate driver 14 sequentially supplies the erase signals EP1 to EPn to the second gate lines 17 and erases the display lines of the display panel 10 in the forward direction at a first erase speed slower than the writing speed during the first erase time Te1 and at a second erase speed faster than the writing speed during the second erase time Te2.

As described above, this differently adjusts the erase speed depending on the portions of the divided compensation subframe (i.e., causes the erase speed to be slower than the writing speed in the portion of the compensation subframe and to be faster than the writing speed in the remaining portion of the compensation subframe) when the high potential power voltage EVDD is simultaneously applied to the display panel 10 from both the upper side UP and the lower side DOWN of the display panel 10 as shown in FIG. 12. Hence, the embodiment of the invention gradually increases the emission time EMT as it goes from the upper side UP and the lower side DOWN to the middle part MIDD of the display panel 10, thereby removing the luminance deviation resulting from the IR drop depending on the position of the display panel 10.

Figure 14:
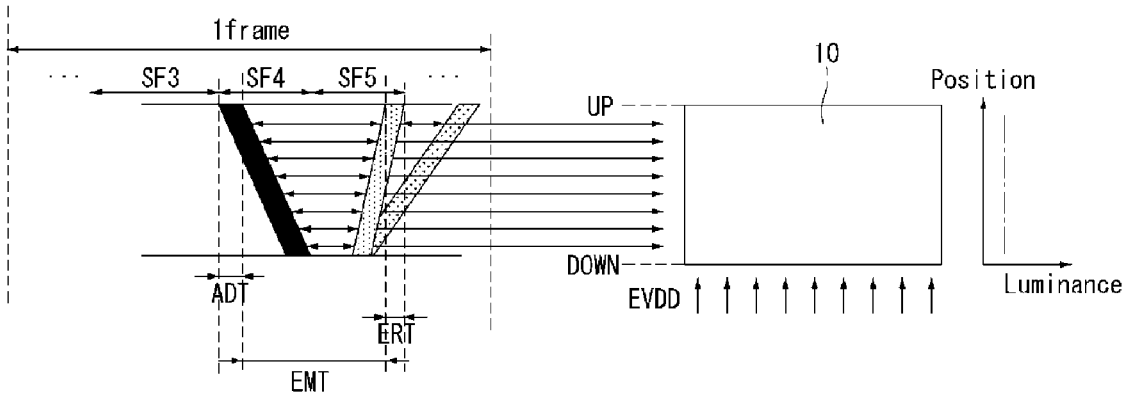
FIG. 14 shows an example where a scanning direction and an erase direction in a specific compensation subframe are reversely adjusted as another method for minimizing a luminance deviation resulting from IR drop, according to one or more embodiments.
Figure 15A:
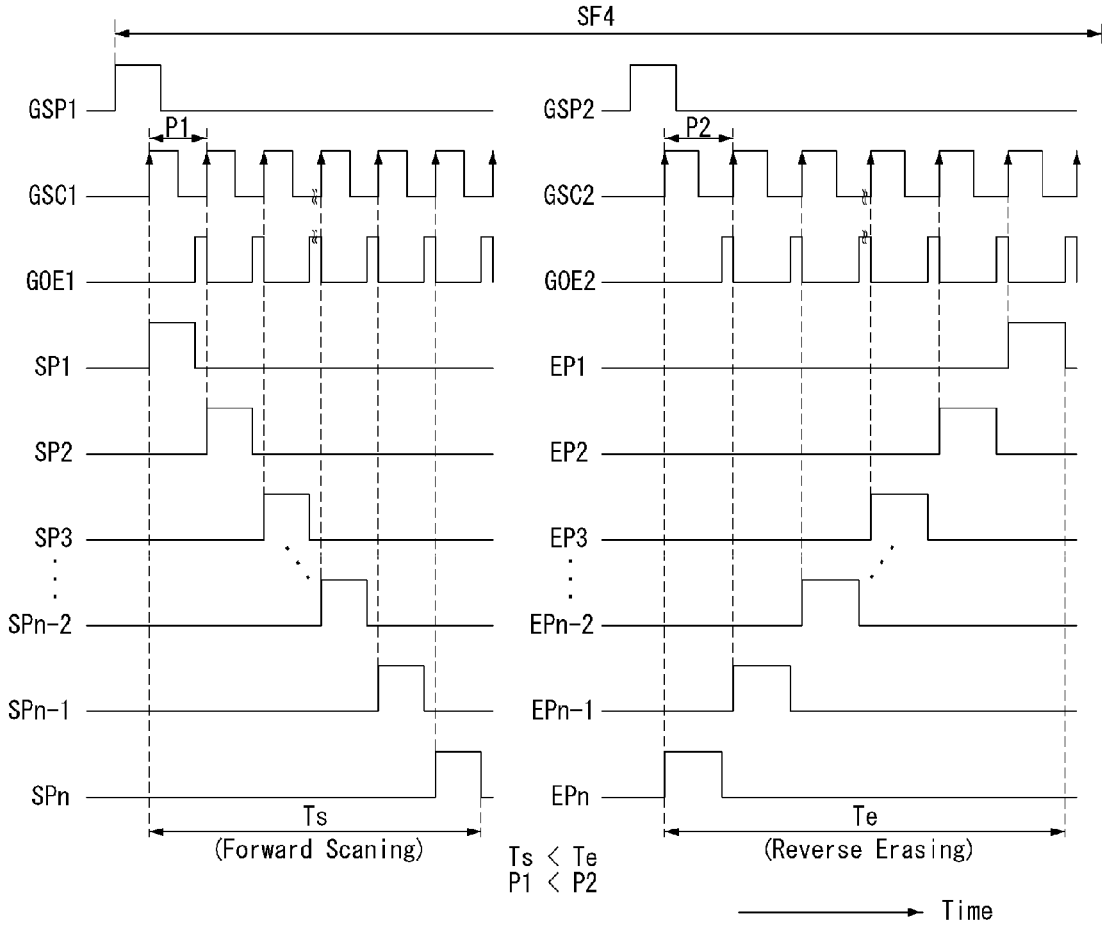
FIGS. 15A to 15C show example timing diagrams where an erase speed in a compensation subframe is differently controlled depending on a degree of IR drop, according to one or more embodiments.
Figure 15B:
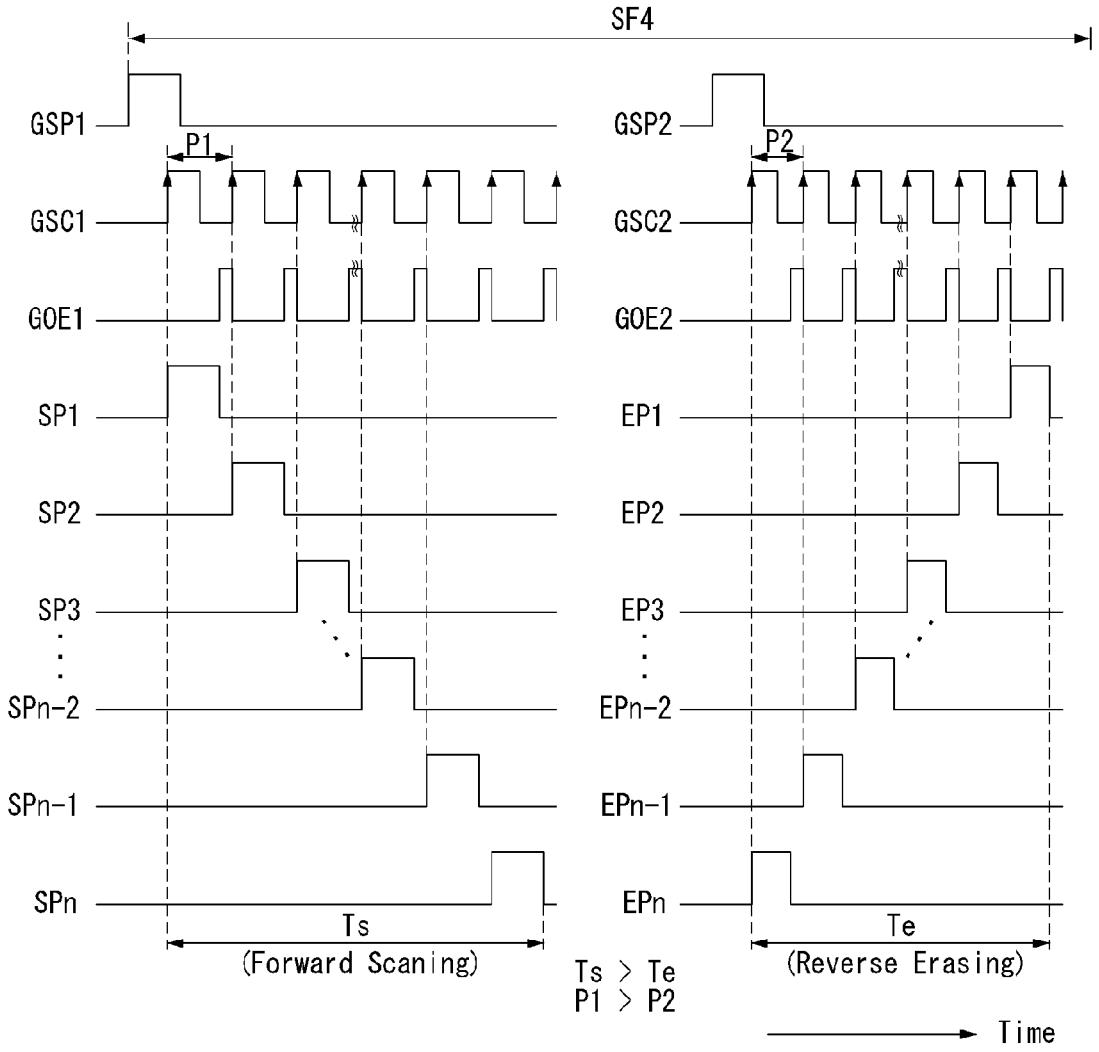
Figure 15C:
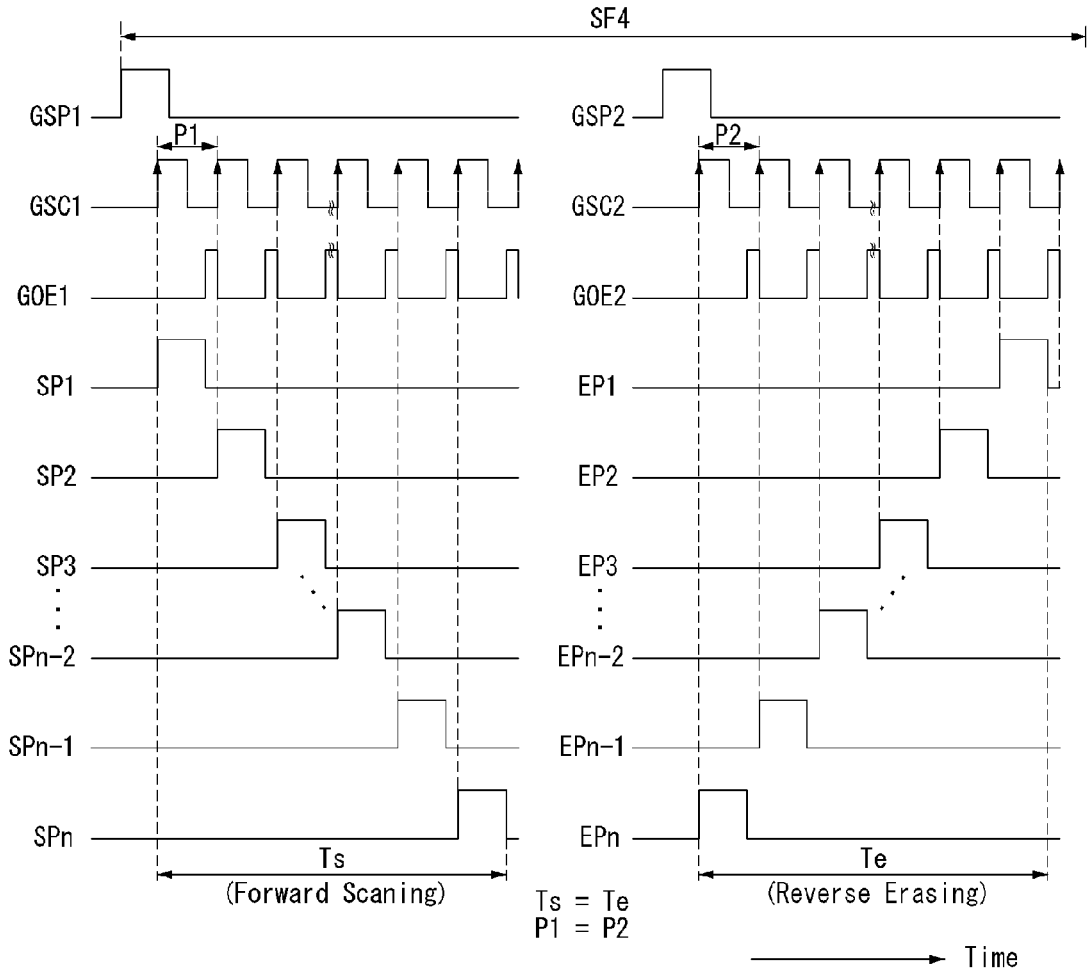

FIG. 14 shows an example where a scanning direction and an erase direction in a specific compensation subframe are reversely adjusted as another method for minimizing the luminance deviation resulting from the IR drop. FIGS. 15A to 15C show examples where an erase speed in a compensation subframe is differently controlled depending on a degree of the IR drop.

As shown in FIG. 14, in the OLED display according to a still further embodiment, the high potential power voltage EVDD for driving the pixels is applied to the display panel 10 from the lower side DOWN of the display panel 10, and the data write may be sequentially performed from the upper side UP to the lower side DOWN of the display panel 10 in the sequential line manner. In this instance, a luminance at the upper side UP of the display panel 10 may be less than a luminance at the lower side DOWN of the display panel 10 because of the IR drop.

To reduce the luminance deviation along positions of the display panel 10, the timing controller 11 controls the operations of the display panel drivers 12, 13, and 14 such that a scanning direction for the data write and an erase direction for turning off the pixels may be reversed in at least one compensation subframe (for example, SF4) of a plurality of subframes belonging to one frame. For example, the timing controller 11 may define the scanning direction as a forward direction and define the erase direction as a reverse direction. Hence, the timing controller 11 can gradually increase the emission time EMT as it goes from the lower side DOWN to the upper side UP of the display panel 10.

The erase speed of the reverse direction may be differently determined depending on a degree of the luminance deviation resulting from variations in IR drop on the upper and lower sides of the display panel 10.

When the luminance deviation is large, the timing controller 11 may cause the erase speed of the reverse direction to be slower than the writing speed of the forward direction in the compensation subframe SF4. For this, as shown in FIG. 15A, the timing controller 11 may cause a total application time Te of the erase signals EP1 to EPn to be longer than a total application time Ts of the scan signals SP1 to SPn. The timing controller 11 may cause a first gate shift clock GSC1, that forms the basis of the generation of the scan signals SP1 to SPn, to have a first pulse period P1 and may cause a second gate shift clock GSC2, that forms the basis of the generation of the erase signals EP1 to EPn, to have a second pulse period P2 longer than the first pulse period P1. The first gate driver 13 sequentially supplies the scan signals SP1 to SPn to the first gate lines 16 in the forward direction and scans the display lines of the display panel 10 in the forward direction during the total scanning time Ts. The second gate driver 14 sequentially supplies the erase signals EP1 to EPn to the second gate lines 17 in the reverse direction and erases the display lines of the display panel 10 in the reverse direction during the total erase time Te longer than the total scanning time Ts.

Conversely, when the luminance deviation is small, the timing controller 11 may cause the erase speed of the reverse direction to be faster than the writing speed of the forward direction in the compensation subframe SF4. For this, as shown in FIG. 15B, the timing controller 11 may cause a total application time Te of the erase signals EP1 to EPn to be shorter than a total application time Ts of the scan signals SP1 to SPn. The timing controller 11 may set the first gate shift clock GSC1, that forms the basis of the generation of the scan signals SP1 to SPn, to have the first pulse period P1 and may set the second gate shift clock GSC2, that forms the basis of the generation of the erase signals EP1 to EPn, to have the second pulse period P2 shorter than the first pulse period P1. The first gate driver 13 sequentially supplies the scan signals SP1 to SPn to the first gate lines 16 in the forward direction and scans the display lines of the display panel 10 in the forward direction during the total scanning time Ts. The second gate driver 14 sequentially supplies the erase signals EP1 to EPn to the second gate lines 17 in the reverse direction and erases the display lines of the display panel 10 in the reverse direction during the total erase time Te shorter than the total scanning time Ts.

Alternatively, as shown in FIG. 15C, when the luminance deviation is small, the timing controller 11 may cause the erase speed of the reverse direction to be same as the writing speed of the forward direction in the compensation subframe SF4.

Figures 16, 17:
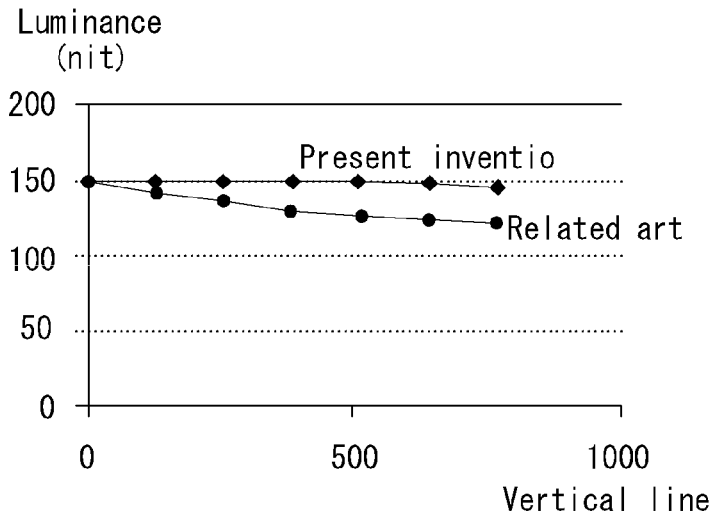
FIGS. 16 and 17 show comparisons between simulation results for the disclosed approaches and related art approaches.

FIGS. 16 and 17 illustrate comparisons between simulation results for the disclosed embodiments and for related art approaches.

FIG. 16 illustrates results from an implementation according to the embodiment shown in FIG. 8 and measured luminances depending on the position of the display panel. Referring to FIG. 16, an increase in a value of a vertical line indicates that the position of the display panel is close to the lower side of the display panel.

As can be seen from the simulation result of FIGS. 16 and 17, according to the embodiment of the invention a deviation between the luminances of the upper and lower sides of the display panel, is reduced in comparison with corresponding results from the related art approach.

As described above, the disclosed approaches select at least one of the plurality of subframes belonging to one frame as the compensation subframe and cause the erase speed for turning off the pixels to be faster or slower than the writing speed for the data write in the compensation subframe, thereby differently controlling the emission times of the upper and lower display lines of the display panel. This reduces the luminance deviation resulting from varying IR drops across pixel signal lines, across portions of the panel.

Furthermore, this embodiment selects at least one of the plurality of subframes belonging to one frame as the compensation subframe and reversely controls the scanning direction for the data write and the erase direction for turning off the pixels in the compensation subframe, thereby differently controlling the emission times of the upper and lower display lines of the display panel. This can minimize the luminance deviation resulting from the IR drop.

Although embodiments have been described with reference to a number of illustrative embodiments thereof, it should be understood that numerous other modifications and embodiments can be devised by those skilled in the art that will fall within the scope of the principles of the present disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

An organic light emitting diode display includes: a display panel including a plurality of pixels; a display panel driver configured to drive signal lines of the display panel; and a timing controller configured to divide one frame into a plurality of subframes, divide data of an input image at each bit, map the data of the input image to the plurality of subframes, control an operation of the display panel driver, and differently adjust a writing speed for writing data and an erase speed for turning off the pixels in at least one compensation frame of the plurality of subframes.

Optionally, when a high potential power voltage for driving the pixels is applied to the display panel from an upper side of the display panel, and the data write is sequentially performed from the upper side of the display panel to a lower side of the display panel opposite the upper side in a sequential line manner, the timing controller controls an operation of the display panel driver such that the erase speed is slower than the writing speed in the compensation subframe.

Optionally, the timing controller controls a total application time of erase signals for turning off the pixels to be longer than a total application time of scan signals for writing the data in the compensation subframe, and the timing controller controls a first gate shift clock, that forms the basis of the generation of the scan signals, to have a first pulse period and controls a second gate shift clock, that forms the basis of the generation of the erase signals, to have a second pulse period longer than the first pulse period.

Optionally, when a high potential power voltage for driving the pixels is applied to the display panel from a lower side of the display panel, and the data write is sequentially performed from an upper side opposite the lower side of the display panel to the lower side of the display panel in a sequential line manner, the timing controller controls an operation of the display panel driver such that the erase speed is faster than the writing speed in the compensation subframe.

Optionally, the timing controller controls a total application time of erase signals for turning off the pixels to be shorter than a total application time of scan signals for writing the data in the compensation subframe, and the timing controller controls a first gate shift clock, that forms the basis of the generation of the scan signals, to have a first pulse period and controls a second gate shift clock, that forms the basis of the generation of the erase signals, to have a second pulse period shorter than the first pulse period.

Optionally, when a high potential power voltage for driving the pixels is applied to the display panel from an upper side and a lower side of the display panel that are opposite to each other, and the data write is sequentially performed from the upper side to the lower side of the display panel in a sequential line manner, the timing controller controls an operation of the display panel driver such that the erase speed is slower than the writing speed in a portion of the compensation subframe, and then the erase speed is faster than the writing speed in a remaining portion of the compensation subframe.

Optionally erase signals for turning off the pixels include first erase signals applied in the portion of the compensation subframe and second erase signals applied in the remaining portion of the compensation subframe, and the timing controller controls a total application time of the erase signals to be same as a total application time of scan signals for writing the data in the compensation subframe, divides the total application time of the erase signals into a first erase time, during which the first erase signals are applied, and a second erase time, during which the second erase signals are applied, and controls the first erase time to be longer than the second erase time, and the timing controller controls a first gate shift clock, that forms the basis of the generation of the scan signals, to have a first pulse period and controls a second gate shift clock, that forms the basis of the generation of the erase signals, to have a second pulse period longer than the first pulse period during the first erase time and to have a third pulse period shorter than the first pulse period during the second erase time.

Optionally, the timing controller reversely adjusts a scanning direction for writing the data and an erase direction for turning off the pixels in the compensation subframe.

Optionally, an erase speed for turning off the pixels is determined based on a luminance deviation depending on a position of the display panel in the compensation subframe.

Optionally, each of the plurality of subframes includes a writing time during which the data is written on the pixels, an emission time during which the pixels emit light, and an erase time during which the pixels are turned off.

There is also provided a method for driving an organic light emitting diode display including a display panel including a plurality of pixels and a display panel driver driving signal lines of the display panel, the method including: dividing one frame into a plurality of subframes, dividing data of an input image at each bit, and mapping the data of the input image to the plurality of subframes; and controlling an operation of the display panel driver and differently adjusting a writing speed for writing data and an erase speed for turning off the pixels in at least one compensation frame of the plurality of subframes.

Optionally the method further includes reversely adjusting a scanning direction for writing the data and an erase direction for turning off the pixels in the compensation subframe.

Optionally, an erase speed for turning off the pixels is determined based on a luminance deviation depending on a position of the display panel in the compensation subframe.

Optionally, each of the plurality of subframes includes a writing time during which the data is written on the pixels, an emission time during which the pixels emit light, and an erase time during which the pixels are turned off.

What is claimed is:

1. An organic light emitting diode display comprising:

a display panel including a plurality of pixels;

a display panel driver configured to drive signal lines of the display panel; and a timing controller configured to:

divide one frame into a plurality of subframes;

convert data of an input image into a bit pattern;

map the bit pattern to the plurality of subframes;

control an operation of the display panel driver; and adjust a writing speed for writing data and/or an erase speed for turning off pixels of the plurality of pixels during at least one compensation subframe of the plurality of subframes such that the writing speed and the erase speed are different from each other, wherein the writing speed is determined in inverse proportion to a total application time of scan signals for writing the data in the compensation subframe, and the erase speed is determined in inverse proportion to a total application time of the erase signals for turning off the pixels in the compensation subframe;

wherein when a high potential power voltage for driving the plurality of pixels is applied to the display panel from a first side of the display panel, and writing data is sequentially performed from the first side of the display panel to a second side of the display panel opposite the first side sequentially in a line-by-line manner, the timing controller is configured to control an operation of the display panel driver such that the erase speed is slower than the writing speed in the at least one compensation subframe, wherein the timing controller is further configured to control a total application time of erase signals for turning off the plurality of pixels to be longer than a total application time of the scan signals for writing the data during the at least one compensation subframe, and wherein the timing controller is also configured to:

control a first gate shift clock, that triggers generation of the scan signals, to have a first pulse period; and control a second gate shift clock, that triggers generation of the erase signals, to have a second pulse period longer than the first pulse period.

2. An organic light emitting diode display comprising:

a display panel including a plurality of pixels;

a display panel driver configured to drive signal lines of the display panel; and a timing controller configured to:

divide one frame into a plurality of subframes;

convert data of an input image into a bit pattern;

map the bit pattern to the plurality of subframes;

control an operation of the display panel driver; and adjust a writing speed for writing data and/or an erase speed for turning off pixels of the plurality of pixels during at least one compensation subframe of the plurality of subframes such that the writing speed and the erase speed during the compensation subframe are different from each other, wherein the writing speed is determined in inverse proportion to a total application time of scan signals for writing the data in the compensation subframe, and the erase speed is determined in inverse proportion to a total application time of the erase signals for turning off the pixels in the compensation subframe;

wherein, when a high potential power voltage for driving the plurality of pixels is applied to the display panel from a second side of the display panel, and writing data is sequentially performed from a first side opposite the second side of the display panel to the second side of the display panel sequentially in a line-by-line manner, the timing controller is configured to control an operation of the display panel driver such that the erase speed is faster than the writing speed during the at least one compensation subframe, wherein the timing controller is further configured to control a total application time of erase signals for turning off the plurality of pixels to be shorter than a total application time of the scan signals for writing the data during the at least one compensation subframe, and wherein the timing controller is also configured to:

control a first gate shift clock, that triggers generation of the scan signals, to have a first pulse period; and control a second gate shift clock, that triggers generation of the erase signals, to have a second pulse period shorter than the first pulse period.

3. An organic light emitting diode display comprising:

a display panel including a plurality of pixels;

a display panel driver configured to drive signal lines of the display panel; and a timing controller configured to:

divide one frame into a plurality of subframes;

convert data of an input image into a bit pattern;

map the bit pattern to the plurality of subframes;

control an operation of the display panel driver; and adjust a writing speed for writing data and/or an erase speed for turning off pixels of the plurality of pixels during at least one compensation subframe of the plurality of subframes such that the writing speed and the erase speed during the compensation subframe are different from each other, wherein the writing speed is determined in inverse proportion to a total application time of scan signals for writing the data in the compensation subframe, and the erase speed is determined in inverse proportion to a total application time of the erase signals for turning off the pixels in the compensation subframe;

wherein, when a high potential power voltage for driving the plurality of pixels is applied to the display panel from both a first side and a second side of the display panel that are opposite to each other, and writing data is sequentially performed from the first side to the second side of the display panel sequentially in a line-by-line manner, the timing controller is configured to control an operation of the display panel driver such that the erase speed is slower than the writing speed during a portion of the at least one compensation subframe, and the erase speed is faster than the writing speed during a remaining portion of the at least one compensation subframe, wherein erase signals for turning off the plurality of pixels include first erase signals applied in the portion of the at least one compensation subframe and second erase signals applied in the remaining portion of the at least one compensation subframe, wherein the timing controller is further configured to:

control a total application time of the erase signals to be same as a total application time of the scan signals for writing the data during the at least one compensation subframe;

divide the total application time of the erase signals into a first erase time, during which the first erase signals are applied, and a second erase time, during which the second erase signals are applied; and control the first erase time to be longer than the second erase time, and wherein the timing controller is also configured to:

control a first gate shift clock to have a first pulse period, that triggers generation of the scan signals; and control a second gate shift clock to have a second pulse period longer than the first pulse period during the first erase time and to have a third pulse period shorter than the first pulse period during the second erase time, wherein the first gate shift clock and second gate shift clock trigger generation of the scan signals and the erase signals, respectively.

4. The organic light emitting diode display according to claim 1, wherein the timing controller is configured to reverse a scanning direction for writing the data relative to an erase direction for turning off pixels of the plurality of pixels during the at least one compensation subframe.

5. The organic light emitting diode display according to claim 1, wherein an erase speed for turning off pixels of the plurality of pixels is determined based on a luminance deviation depending on a position on the display panel during the at least one compensation subframe.

6. The organic light emitting diode display according to claim 1, wherein each of the plurality of subframes includes a writing time during which the data is written to pixels of the plurality of pixels, an emission time during which the pixels emit light, and an erase time during which the pixels are turned off.

7. A method for driving an organic light emitting diode display including a display panel including a plurality of pixels and a display panel driver driving signal lines of the display panel, the method comprising:

dividing one frame into a plurality of subframes;

converting data of an input image into a bit pattern;

mapping the bit pattern to the plurality of subframes; and adjusting a writing speed for writing data and/or an erase speed for turning off pixels of the plurality of pixels during at least one compensation subframe of the plurality of subframes, such that the writing speed and the erase speed are different from each other, wherein the writing speed is determined in inverse proportion to a total application time of scan signals for writing the data in the compensation subframe, and the erase speed is determined in inverse proportion to a total application time of the erase signals for turning off the pixels in the compensation subframe;

applying a high potential power voltage for driving the plurality of pixels to the display panel from a first side of the display panel; and writing data sequentially from the first side of the display panel to a second side of the display panel opposite the first side sequentially in a line-by-line manner, wherein the erase speed is slower than the writing speed in the at least one compensation subframe, wherein the total application time of erase signals for turning off the plurality of pixels is longer than a total application time of the scan signals for writing the data in the at least one compensation subframe, and wherein the scan signals have a first pulse period; and the erase signals have a second pulse period longer than the first pulse period.

8. The method according to claim 7, further comprising reversing a scanning direction for writing the data relative to an erase direction for turning off pixels of the plurality of pixels in the at least one compensation subframe.

9. The method according to claim 8, wherein an erase speed for turning off pixels of the plurality of pixels is determined based on a luminance deviation depending on a position on the display panel in the at least one compensation subframe.

10. The method according to claim 7, wherein each of the plurality of subframes includes a writing time during which the data is written to pixels of the plurality of pixels, an emission time during which the pixels emit light, and an erase time during which the pixels are turned off.

11. The method according to claim 7, wherein a first difference between the erase speed and the writing speed in a first portion of the at least one compensation subframe is different from a second difference between the erase speed and the writing speed in a second portion of the at least one compensation subframe.

12. A method for driving an organic light emitting diode display including a display panel including a plurality of pixels and a display panel driver driving signal lines of the display panel, the method comprising:

dividing one frame into a plurality of subframes;

converting data of an input image into a bit pattern;

mapping the bit pattern to the plurality of subframes; and adjusting a writing speed for writing data and/or an erase speed for turning off pixels of the plurality of pixels during at least one compensation subframe of the plurality of subframes, such that the writing speed and the erase speed during the compensation subframe are different from each other, wherein the writing speed is determined in inverse proportion to a total application time of scan signals for writing the data in the compensation subframe, and the erase speed is determined in inverse proportion to a total application time of the erase signals for turning off the pixels in the compensation subframe;

applying a high potential power voltage for driving the plurality of pixels is applied to the display panel from a second side of the display panel; and writing data sequentially from a first side opposite the second side of the display panel to the second side of the display panel sequentially in a line-by-line manner, wherein the erase speed is faster than the writing speed in the at least one compensation subframe, wherein the total application time of erase signals for turning off the plurality of pixels is shorter than the total application time of the scan signals for writing the data in the at least one compensation subframe, and wherein the scan signals have a first pulse period and the erase signals have a second pulse period shorter than the first pulse period.

13. A method for driving an organic light emitting diode display including a display panel including a plurality of pixels and a display panel driver driving signal lines of the display panel, the method comprising:

dividing one frame into a plurality of subframes;

converting data of an input image into a bit pattern;

mapping the bit pattern to the plurality of subframes;

adjusting a writing speed for writing data and/or an erase speed for turning off pixels of the plurality of pixels in at least one compensation subframe of the plurality of subframes, such that the writing speed and the erase speed are different from each other, wherein the writing speed is determined in inverse proportion to a total application time of scan signals for writing the data in a portion of the compensation subframe, and the erase speed is determined in inverse proportion to a total application time of the erase signals for turning off the pixels in the portion of the compensation subframe;

applying a high potential power voltage for driving the plurality of pixels to the display panel from a first side and a second side of the display panel that are opposite to each other; and writing data sequentially from the first side to the second side of the display panel sequentially in a line-by-line manner, wherein the erase speed is slower than the writing speed in a portion of the at least one compensation subframe and the erase speed is faster than the writing speed in a remaining portion of the at least one compensation subframe, wherein erase signals for turning off the plurality of pixels include first erase signals applied in a first portion of the at least one compensation subframe and second erase signals applied in the remaining portion of the at least one compensation subframe, and wherein the total application time of the erase signals is the same as a total application time of the scan signals for writing the data in the at least one compensation subframe, the method further comprising:

dividing the total application time of the erase signals into a first erase time, during which the first erase signals are applied, and a second erase time, during which the second erase signals are applied; and controlling the first erase time to be longer than the second erase time, wherein a first pulse period forms the basis of the generation of the scan signals, a second pulse period longer than the first pulse period forms the basis of the generation of the erase signals during the first erase time and a third pulse period shorter than the first pulse period forms the basis of the erase signals during the second erase time.

14. The organic light emitting diode display according to claim 2, wherein the timing controller is configured to reverse a scanning direction for writing the data relative to an erase direction for turning off pixels of the plurality of pixels during the at least one compensation subframe.

15. The organic light emitting diode display according to claim 3, wherein the timing controller is configured to reverse a scanning direction for writing the data relative to an erase direction for turning off pixels of the plurality of pixels during the at least one compensation subframe.

16. The method according to claim 12, further comprising reversing a scanning direction for writing the data relative to an erase direction for turning off pixels of the plurality of pixels in the at least one compensation subframe.

17. The method according to claim 13, further comprising reversing a scanning direction for writing the data relative to an erase direction for turning off pixels of the plurality of pixels in the at least one compensation subframe.

* * * * *